US007257195B2

(12) United States Patent
Freund et al.

(10) Patent No.: US 7,257,195 B2
(45) Date of Patent: Aug. 14, 2007

(54) COLLIMATOR FOR A COMPUTER TOMOGRAPH

(75) Inventors: Andreas Freund, Heroldsbach (DE); Claus Pohan, Baiersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 154 days.

(21) Appl. No.: 11/020,085

(22) Filed: Dec. 23, 2004

(65) Prior Publication Data

US 2005/0135562 A1 Jun. 23, 2005

(30) Foreign Application Priority Data

Dec. 23, 2003 (DE) ..... 103 61 510

(51) Int. Cl.
*G21K 1/02* (2006.01)

(52) U.S. Cl. ..... 378/149; 378/147

(58) Field of Classification Search ..... 378/147, 378/149, 154; 250/505.1
See application file for complete search history.

(56) References Cited

U.S. PATENT DOCUMENTS 4,446,570 A * 5/1984 Guth ..... 378/149
5,799,057 A 8/1998 Hoffman et al.
6,055,296 A * 4/2000 Ferlic et al. ..... 378/145
6,134,301 A 10/2000 Mruzek et al.
6,587,538 B2 7/2003 Igarashi et al.
2003/0223548 A1* 12/2003 Galish et al. ..... 378/147

FOREIGN PATENT DOCUMENTS

DE 197 53 268 A1 7/1998
DE 100 11 877 C2 8/2002
DE 101 58 021 A1 8/2002

OTHER PUBLICATIONS

German Office Action (dated Jan. 11, 2007) for counterpart German Patent Application No. 103 61 510.5.

* cited by examiner

*Primary Examiner*—Edward J. Glick
*Assistant Examiner*—Chih-Cheng Glen Kao
(74) *Attorney, Agent, or Firm*—Harness, Dickey & Pierce, P.L.C.

(57) ABSTRACT

A collimator for a computer tomograph includes a number of collimator plates and a holder for the collimator plates. The collimator plates include, at the edge, a number of tabs spaced apart from one another. In a fashion corresponding to this, the holder has receptacles that are assigned to the tabs and that are spaced apart from one another, into which the tabs of the collimator plates engage. This configuration ensures highly accurate positioning of even long collimator plates.

15 Claims, 3 Drawing Sheets

COLLIMATOR FOR A COMPUTER TOMOGRAPH

The present application hereby claims priority under 35 U.S.C. §119 on German patent application number DE 103 61 510.5 filed Dec. 23, 2003, the entire contents of which are hereby incorporated herein by reference.

FIELD OF THE INVENTION

The invention generally relates to a collimator for a computer tomograph including a number of collimator plates and a holder for the collimator plates.

BACKGROUND OF THE INVENTION

A collimator or scattering collimator is to be gathered, for example, from DE 100 11 877 C2. The collimator is arranged in a detector arrangement of a computer tomograph. The collimator plates are arranged here in a radial direction relative to an X-radiation source of the computer tomograph, and serve to reduce or suppress scattered radiation that deviates from the radial direction, and is thus not aligned in a radial direction relative to the radiation source.

Collimators and computer tomographs with built-in collimators are further to be gathered from DE 197 53 268 A1 and DE 101 58 021 A1 for example.

The collimator plates, usually metal plates with a high absorptive power for X-radiation, are held in the collimator in a holder. In accordance with DE 100 11 877 C2, the collimator has an upper housing part and a lower housing part between which the collimator plates are arranged. Slot-like openings into which the collimator plates engage are worked into the two housing parts.

Guides on the housing parts are also provided for the end faces of the collimator plates. The collimator plates are fixed in their position by the worked-in slots and the guides. The housing parts are usually constructed from plastic injection-molded parts.

Imaging by use of the computer tomograph requires collimator plates to be positioned highly precisely and exactly in the prescribed position in a radial direction relative to the radiation source. This requires the housing parts to be constructed as high-precision plastic injection-molded parts. Particularly in the case of long collimator plates, however, there is the problem that because of the nature of the production of plastic injection-molded parts the slots and the webs arranged between neighboring slots can no longer be fabricated with sufficient positional accuracy, or that the required high-precision construction can be implemented only with a considerable cost-intensive outlay. Because of the material elasticity, the generally thin-walled webs are, moreover, unstable and of low rigidity.

SUMMARY OF THE INVENTION

It is an object of an embodiment of the invention to specify a collimator with highly precise orientation of the collimator plates.

An object may be achieved according to an embodiment of the invention by a collimator. This provides that the collimator plates have at the edge a number of tabs spaced apart from one another, and that a holder for the collimator plates has receptacles that are assigned to the tabs and spaced apart from one another and into which the tabs of the collimator plates engage.

This configuration is based on the idea of abandoning the configuration of continuous, elongated cutouts or slots for the collimator plates and, instead, of constructing in a fashion distributed over the length of a collimator plate a number of discrete tabs or tongues spaced apart from one another as well as, in a fashion complimentary thereto, individual and discrete cutouts in the holder. The cutouts for positioning the individual collimator plates therefore do not extend over the entire length. Rather, it is now only short segments in the holder that have material windows. These windows or cutouts can be positioned in a highly accurate fashion with a low outlay. In particular, a substantially higher stability is thereby achieved and the short cutouts are surrounded by a comparatively large material wall.

In accordance with an expedient development, the tab receptacles of two neighboring collimator plates are arranged offset from one another. In this case, the tab receptacles of neighboring collimator plates preferably do not overlap one another. The result of this is that the material weakness caused by the cutouts, and the reduction in rigidity are kept low, since the cutouts are spaced apart as far as possible from one another by their offset arrangement. The overall result of this is to enable a holder with a high intrinsic rigidity and a high positionally accurate construction of cutouts.

The holder expediently includes an upper collimator part and a lower collimator part in which the tab receptacles are respectively arranged. Collimator plates are therefore clamped between two housing parts with the respective tab receptacles. This permits simple mounting while simultaneously ensuring high positional accuracy.

The collimator plates preferably have tabs along their two long sides, the tabs of the opposite long sides being arranged offset from one another. A high torsional rigidity is achieved for a built-in collimator plate by the offset arrangement.

In accordance with a preferred refinement, the tab receptacles of two neighboring collimator plates have two different grid dimensions. At the same time, the tabs are arranged on the long sides of the collimator plates in such a way that the tabs alternately assume the two grid dimensions in that a collimator plate is respectively rotated by 180° about its central normal.

Here, grid dimension of the tabs refers to the distance of the tabs from the end faces of the collimator plates and their distance from one another. Owing to this configuration, only one type of collimator plate is required, and the collimator plates can be used by means of a 180° rotation for both grid dimensions. The collimator plates are therefore constructed in such a way that they can be built in by "turning over". Each collimator plate has both grid dimensions.

In order to enable simple production, the tab receptacles are expediently constructed as openings, that is to say continuous material windows.

In accordance with a preferred development, the tabs reach through the holder. This measure renders it possible for the tabs, that is to say the collimator plates themselves, to participate in the exact positioning of the collimator on an assigned sensor element.

The collimator plates expediently have a length of >40 mm, in particular a length of approximately 60 mm. Even in the case of this relatively large length of the collimator plates, a highly accurate positioning of the collimator plates is enabled even given a relatively thin-walled construction of the holder owing to the particularly offset arrangement of the individual, discrete tab receptacles. The holder is expediently a plastic injection-molded part for the purpose of simple production.

BRIEF DESCRIPTION OF THE DRAWINGS

An exemplary embodiment of the invention is explained below in more detail with the aid of the drawings, in which, in schematic and simplified illustrations in each case.

Identically operating parts are provided with the same reference numerals in the figures.

DETAILED DESCRIPTION OF THE EXEMPLARY EMBODIMENTS

Figure 1:
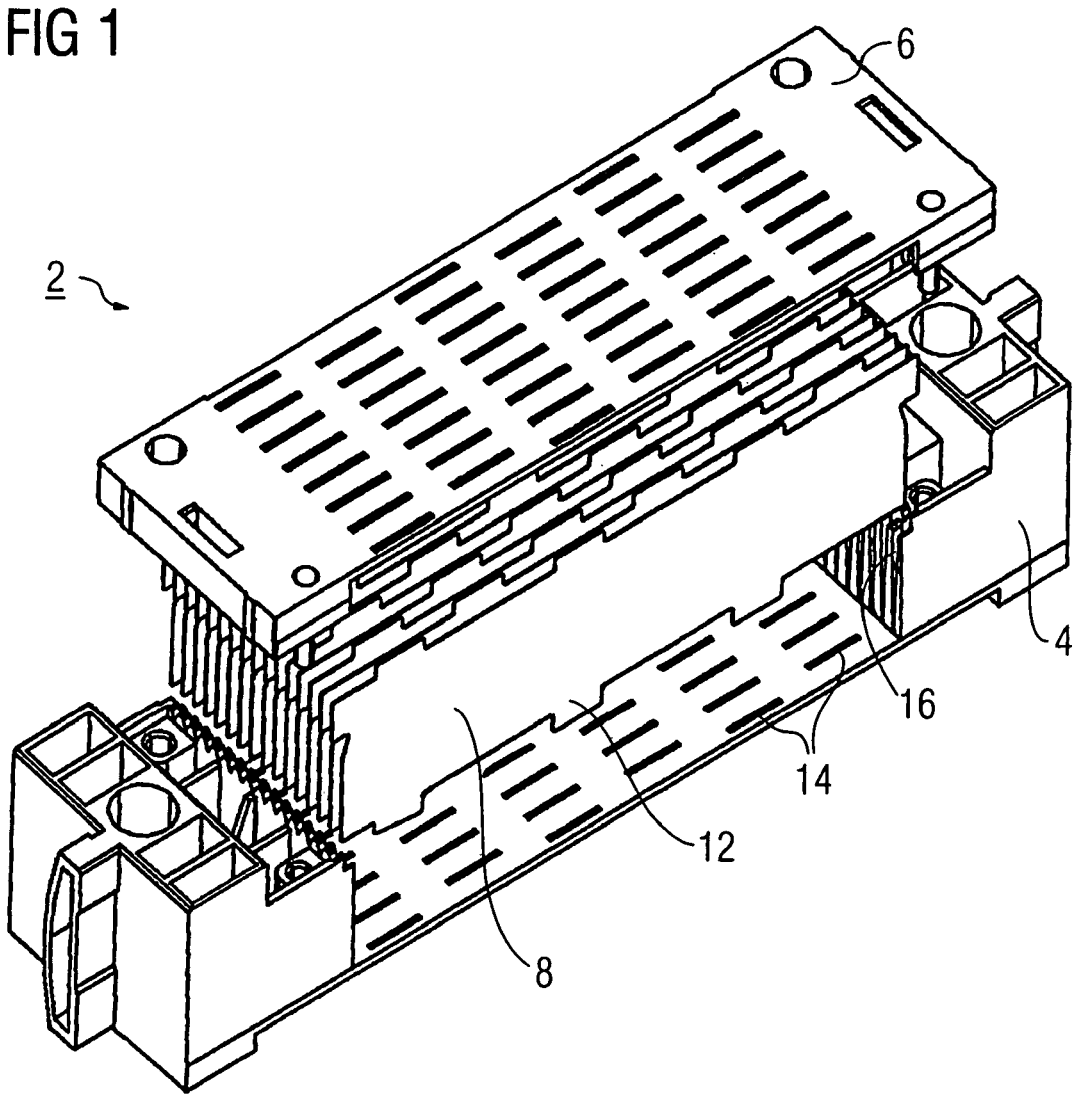
FIG. 1 shows a perspective exploded illustration of a collimator.
Figure 2:
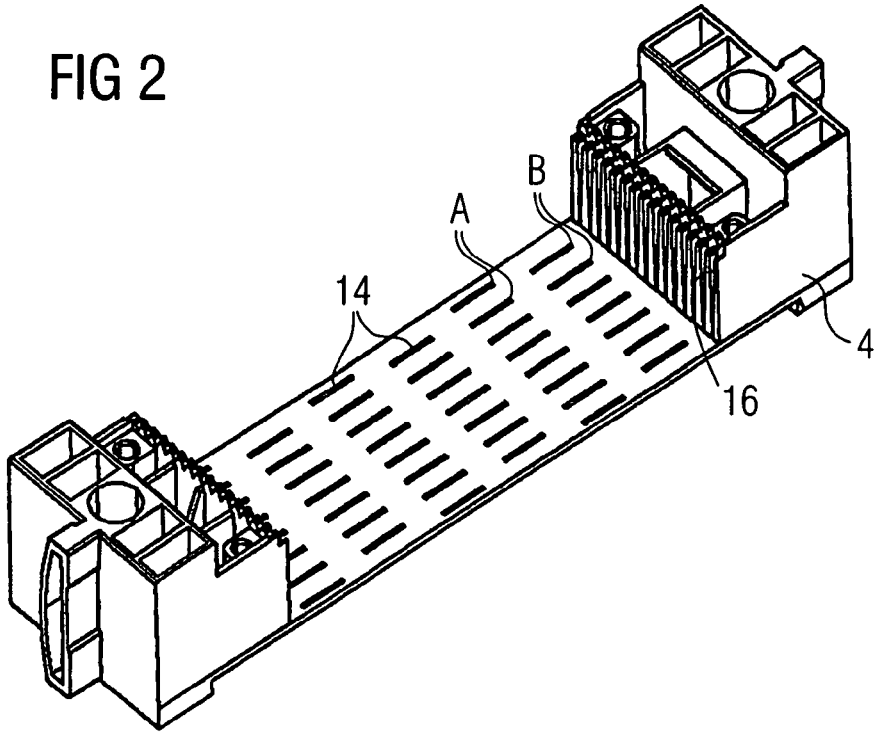
FIG. 2 shows a perspective illustration of a lower collimator part.
Figure 3:
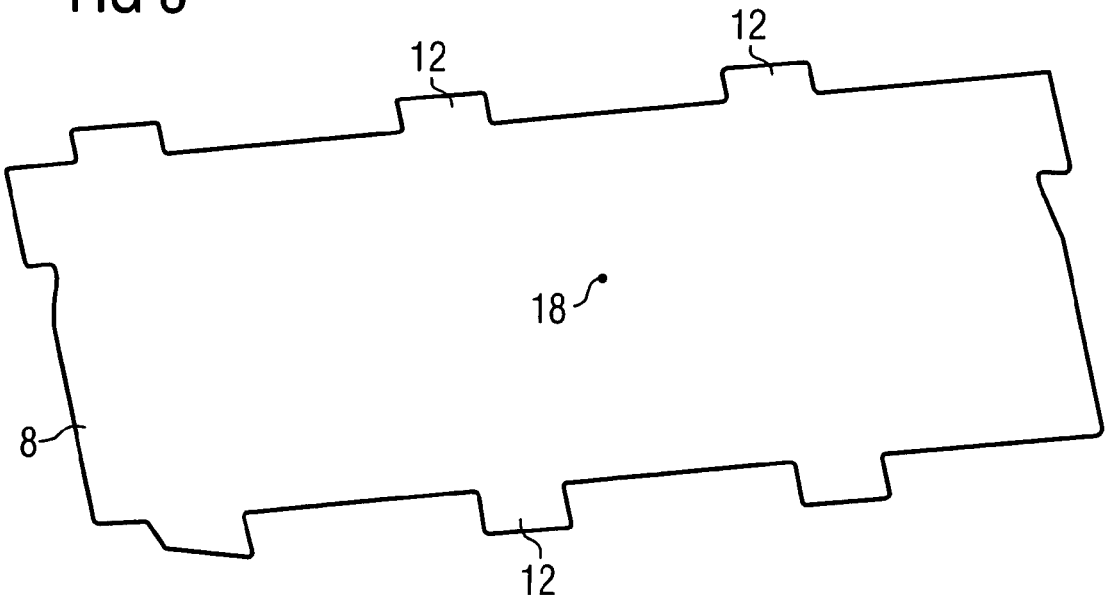
FIG. 3 shows a collimator plate.

A collimator 2 in accordance with FIGS. 1 to 3 includes a lower collimator part 4, an upper collimator part 6 and a plurality of sheet-like collimator plates 8 that are arranged approximately parallel to one another and arranged in the shape of a fan relative to a beam focus of an X-ray source. The lower collimator part 4 and the upper collimator part 6 form a holder for the collimator plates 8 and are connected to one another in the assembled state in the manner of two housing parts.

The collimator plates 8 must be positioned very exactly in the collimator 2. In order to ensure a highly accurate positioning even with very elongated collimator plates 8, which are approximately 60 mm long in the exemplary embodiment, individual tabs 12 are constructed at the edge of the long sides on each of the collimator plates 8. These tabs project in the manner of tongues from the long sides. The individual tabs 12 from the respective long side are spaced apart from one another at uniform distances. The tabs 12 on the two opposite long sides are arranged offset from one another, for example (not illustrated).

The individual tabs 12 are assigned tab receptacles 14, constructed as material openings, both in the lower collimator part 4 and in the upper collimator part 6. In the assembled state, these slot-shaped tab receptacles 14 are penetrated by the individual tabs 12 of the respective collimator plates 8. Provided in addition at the end face on the lower collimator part 4 are groove-like cutouts 16 in which the collimator plates 8 are guided and held with their end faces.

An exact positioning of the collimator plates 8 inside the collimator 2 is ensured by the arrangement of the tabs 12 on the collimator plates 8 and by the corresponding construction of the tab receptacles 14. Since the tab receptacles 14 have only a relatively short length in each case and do not reach over the total length of the collimator plates 8, the cutting out of material undertaken is slight by comparison with a continuous slot. Consequently, the lower collimator part 4 and the upper collimator part 6 are comparatively weakened only a little by the incorporation of the tab receptacles 14, thus ensuring a high dimensional stability of the parts 4, 6, which are usually produced as plastic injection-molded parts.

In addition, the individual tab receptacles 14 can be exactly arranged without any problem owing to the relatively short length and the discrete or individual arrangement of the tab receptacles 14 during the production process of injection molding. In addition, this highly accurate positioning can be achieved even given low wall thicknesses of the parts 4, 6, since comparatively little material is cut out overall.

As is to be gathered from FIGS. 1 and 2, the tab receptacles 14 that are provided for neighboring collimator plates 8 are arranged offset from one another. In the exemplary embodiment, the offset arrangement is constructed in such a way that the individual tab receptacles 14 do not overlap. The distance between two consecutive tab receptacles 14 that are respectively assigned to a collimator plate is greater in this case in the length of a tab receptacle 14. Two grid dimensions A, B are provided for the tab receptacles 14 in the exemplary embodiment, two grid dimensions A, B respectively alternating with one another.

Here, grid dimension is understood as a distance of the individual tab receptacles 14 from the respective end faces of the lower collimator part 4 or the upper collimator part 6, as well as their distances from one another. Consequently, the tab receptacles 14 arranged on a line along the longitudinal extent of the collimator plates 8 are alternatively assigned to a grid dimension A or a grid dimension B, as is illustrated in FIG. 2. This alternating sequence forms rows of tab receptacles 14 running transverse to the longitudinal extent, the tab receptacles 14 of one row belonging respectively to the same grid dimension A, B. Mutually neighboring rows of the tab receptacles 14 are therefore respectively assigned to a different grid dimension A, B.

In a fashion corresponding to this, the tabs 12 on the collimator plates 8 are also arranged in accordance with the grid dimensions A, B. It is possible in this case to provide two sets of collimator plates 8 for which the tabs 12 are respectively constructed for only one grid dimension.

In the exemplary embodiment, the tabs 12 are arranged in such a way that the different grid dimensions A, B are assumed alternately, given a 180° rotation of the respective collimator plate 8 about its central normal 18. In the exemplary embodiment in accordance with FIG. 3, this means, for example, that starting from the left-hand end face the upper tabs 12 are spaced apart from the left-hand end face and from one another in such a way that the grid dimension A is implemented, for example. Conversely, starting from the right-hand edge face of the collimator plate 8, the distances of the individual tabs 12 from the right-hand edge side and from one another are simultaneously selected in such a way that the grid dimension B is implemented from this side. As a result, the collimator plate 8 may be used for both grid dimensions A, B and only one type of collimator plate 8 is required.

Figure 4:
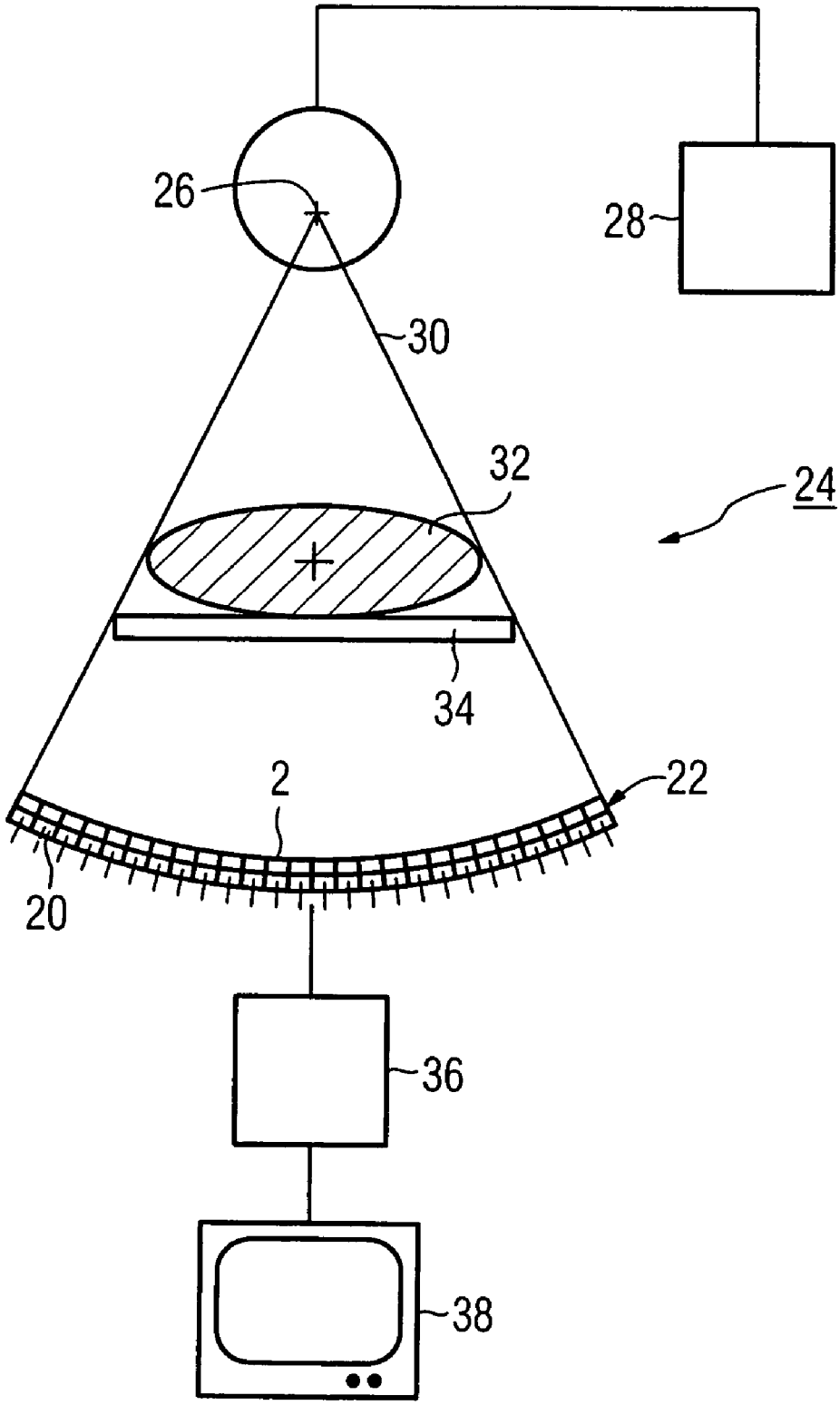
FIG. 4 shows a greatly simplified schematic of a computer tomograph.

As emerges from FIG. 4, a multiplicity of collimators 2 are arranged next to one another along an arcuate line and, together with an equally large number of sensor or detector elements 20 arranged downstream of the collimators 2, form a detector 22 of a computer tomograph 24. In accordance with the simplified illustration according to FIG. 4, in addition to the detector 22, the computer tomograph 24 further includes an X-ray source 26 that is driven by a control unit 28. During operation, the X-ray source 26 produces a fan-shaped X-ray beam 30 that trans-irradiates a disk-shaped volume of a patient 32, who normally lies on a couch 34. The X-radiation is detected by the detector 22. From there, the detected signals are led to an evaluation unit 36 that then converts the signals into image signals which are displayed, for example, on a display element 38.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A collimator for a computer tomograph, comprising:

a number of collimator plates; and a holder for the collimator plates, wherein the collimator plates include, at an edge, a number of tabs spaced apart from one another, and wherein the holder includes tab receptacles assigned to the tabs and spaced apart from one another, into which the tabs of the collimator plates are adapted to engage; wherein the tab receptacles for two neighboring collimator plates are arranged offset from one another such that individual tab receptacles do not overlap in a direction normal to the neighboring collimator plates.

2. The collimator as claimed in claim 1, wherein the holder includes an upper collimator part and a lower collimator part in which the tab receptacles are respectively arranged.

3. The collimator as claimed in claim 2, wherein the collimator plates include tabs along two relatively long sides, the tabs of opposite long sides being arranged offset from one another.

4. The collimator as claimed in claim 1, wherein the collimator plates include tabs along two relatively long sides, the tabs of opposite long sides being arranged offset from one another.

5. The collimator as claimed in claim 1, wherein the tab receptacles for two neighboring collimator plates include two different grid dimensions, and wherein the tabs are arranged on two relatively long sides of a respective collimator plate such that the tabs alternately assume the two grid dimensions, and wherein neighboring collimator plates are rotated 180° relative to one another, the rotation being about a central normal of one of the neighboring collimator plates.

6. The collimator as claimed in claim 1, wherein the tab receptacles are constructed as openings.

7. The collimator as claimed in claim 1, wherein the tabs reach through the holder.

8. The collimator as claimed in claim 1, wherein the collimator plates include a length of >40 mm.

9. The collimator as claimed in claim 1, wherein the holder is a plastic injection-molded part.

10. The collimator as claimed in claim 1, wherein the collimator plates include a length of approximately 60 mm.

11. A collimator for a computer tomograph, comprising:

a plurality of collimator plates, each including a plurality of tabs; and a holder for the collimator plates including a plurality of tab receptacles respectively adapted to receive the plurality of tabs of the collimator plates; wherein the tab receptacles for two neighboring collimator plates are arranged offset from one another such that individual tab receptacles do not overlap in a direction normal to the neighboring collimator plates.

12. The collimator as claimed in claim 11, wherein the holder includes an upper collimator part and a lower collimator part in which the tab receptacles are respectively arranged.

13. The collimator as claimed in claim 11, wherein the collimator plates include tabs along two relatively long sides, the tabs of opposite long sides being arranged offset from one another.

14. The collimator of claim 11, wherein the plurality of tabs are arranged at edges of the plurality of collimator plates.

15. A collimator for a computer tomograph, comprising:

a plurality of collimator plates, each collimator plate including a plurality of tabs arranged on a first side and a plurality of tabs arranged on a second side; and a holder for the collimator plates, the holder including a plurality of tab receptacles, each tab receptacle being adapted to receive a tab of a collimator plate; wherein the tab receptacles for a first of two neighboring collimator plates are spaced apart from a side of the holder differently than tab receptacles for a second of the two neighboring collimator plates, and neighboring collimator plates are arranged in the holder rotated 180° relative to one another, the rotation being about a common central normal of the neighboring collimator plates.

* * * * *